US010852092B1

(12) United States Patent
Lindsay et al.

(10) Patent No.: US 10,852,092 B1
(45) Date of Patent: Dec. 1, 2020

(54) FIREARM SHOOTING REST

(71) Applicant: Battenfeld Technologies, Inc., Columbia, MO (US)

(72) Inventors: Mike Lindsay, Columbia, MO (US); Michael Cottrell, Ashland, MO (US); James Tayon, Moberly, MO (US); Timothy S. Kinney, Warrenton, MO (US); Mark Dalton, Columbia, MO (US); Brian Steere, Columbia, MO (US); Justin Burke, Columbia, MO (US); Kyle Martin, Columbia, MO (US); Dennis W. Cauley, Jr., Fayette, MO (US); Anthony Vesich, Columbia, MO (US); Seth Wheeler, Columbia, MO (US); Matthew Kinamore, Columbia, MO (US); Curtis Smith, Columbia, MO (US)

(73) Assignee: AOB Products Company, Columbia, MO (US)

( * ) Notice: Subject to any disclaimer, the term of this patent is extended or adjusted under 35 U.S.C. 154(b) by 0 days.

(21) Appl. No.: 16/539,676

(22) Filed: Aug. 13, 2019

(51) Int. Cl.
*F41A 23/16* (2006.01)

(52) U.S. Cl.
CPC ..... *F41A 23/16* (2013.01)

(58) Field of Classification Search
CPC ..... F41A 23/02; F41A 23/14; F41A 23/16; F41A 23/18
USPC ..... 42/94
See application file for complete search history.

(56) References Cited

U.S. PATENT DOCUMENTS

| | | | | |
|---|---|---|---|---|
| 3,935,657 | A * | 2/1976 | Wade | F41A 23/00 42/94 |
| 5,233,779 | A * | 8/1993 | Shaw | F41A 23/02 42/94 |
| 5,332,185 | A | 7/1994 | Walker, III | |
| 5,875,580 | A * | 3/1999 | Hill | F41A 23/02 42/94 |
| 6,158,159 | A | 12/2000 | Zekas | |
| 8,104,212 | B2 | 1/2012 | Potterfield et al. | |
| 10,048,034 | B1 * | 8/2018 | Reasor | F41A 23/16 |
| D837,923 | S | 1/2019 | Gleick et al. | |
| 2008/0034636 | A1 | 2/2008 | Potterfield et al. | |

(Continued)

FOREIGN PATENT DOCUMENTS

WO WO-2013040638 A1 * 3/2013 ..... F41A 23/02

OTHER PUBLICATIONS

NPL: (https://www.facebook.com/NIOATV/posts/meet-the-caldwell-tack-driver-x-bag-range-the-most-versatile-shooting-bags-on-th/2607312855948914/) May 6, 2019.*

(Continued)

*Primary Examiner* — John Cooper
(74) *Attorney, Agent, or Firm* — Stinson LLP

(57) ABSTRACT

A firearm rest for supporting a firearm on a support surface to facilitate a shooter in aiming the firearm at a target. The firearm rest includes a body comprising gripping material on different sides of the body. The rest can be used in different orientations such that the gripping material is in contact with both the firearm and the support surface, either the firearm or the support surface, or neither the firearm nor the support surface. The shooting rest includes a hub and protrusions extending from the body. Channels in various sides of the body facilitate use of the rest in different orientations.

26 Claims, 9 Drawing Sheets

(56) References Cited

U.S. PATENT DOCUMENTS

| | | | | |
|---|---|---|---|---|
| 2008/0263928 | A1 | 10/2008 | Potterfield | |
| 2012/0102806 | A1 | 5/2012 | Potterfield et al. | |
| 2014/0215889 | A1 | 8/2014 | Abdennour et al. | |
| 2015/0292830 | A1* | 10/2015 | Treadaway | F41A 23/04 42/94 |
| 2018/0328691 | A1 | 11/2018 | Reasor | |
| 2019/0285376 | A1* | 9/2019 | Bales | F41A 23/16 |

OTHER PUBLICATIONS

Battenfeld Technologies, Inc. 2017 Buyer's Guide, pp. 24-26 (2017) www.BTIbrands.com.

* cited by examiner

FIREARM SHOOTING REST

FIELD

The present disclosure generally relates to firearm accessories, and more particularly to rests for firearms.

BACKGROUND

Various types of firearm rests are known. Shooting rests are used to support part or all of the weight of a firearm to assist a user in shooting the firearm. Shooting rests enable shooters to aim a firearm more steadily at a target and thus improve shooting accuracy.

SUMMARY

In one aspect, a selectively configurable shooting rest for supporting a firearm on a support surface comprises a body having a plurality of sides. A first set of sides of the plurality of sides comprises gripping material configured to frictionally engage the firearm or the support surface to grip the firearm or the support surface. A second set of sides of the plurality of sides comprises slide-permitting material configured to permit the firearm to slide thereon or to slide on the support surface. The rest includes a plurality of firearm cradles. The plurality of firearm cradles includes at least two firearm cradles. Each firearm cradle is defined by a respective side of the body. The firearm cradles are configured to selectively receive the firearm to support the firearm. The body is configurable in at least two orientations selected from a group of orientations including: a first orientation in which a first firearm cradle of the plurality of firearm cradles faces upward for receiving the firearm and a side of the plurality of sides opposite the first firearm cradle faces downward for engaging the support surface, the first firearm cradle being defined by one of the sides comprising slide-permitting material for permitting the firearm to slide thereon, and the side opposite the first firearm cradle being one of the sides comprising gripping material for gripping the support surface; a second orientation in which a second firearm cradle of the plurality of firearm cradles faces upward for receiving the firearm and a side of the plurality of sides opposite the second firearm cradle faces downward for engaging the support surface, the second firearm cradle being defined by one of the sides comprising slide-permitting material for permitting the firearm to slide thereon, and the side opposite the second firearm cradle being one of the sides comprising slide-permitting material for sliding on the support surface; a third orientation in which a third firearm cradle of the plurality of firearm cradles faces upward for receiving the firearm and a side of the plurality of sides opposite the third firearm cradle faces downward for engaging the support surface, the third firearm cradle being defined by one of the sides comprising gripping material for gripping the firearm, and the side opposite the third firearm cradle being one of the sides comprising slide-permitting material for sliding on the support surface; or a fourth orientation in which a fourth firearm cradle of the plurality of cradles faces upward for receiving the firearm and a side of the plurality of sides opposite the fourth firearm cradle faces downward for engaging the support surface, the fourth firearm cradle defined by one of the sides comprising gripping material for gripping the firearm, and the side opposite the fourth firearm cradle being one of the sides comprising gripping material for gripping the support surface.

In another aspect, a shooting rest for supporting a forward portion of a firearm on a support surface comprises a body having a plurality of sides including a first side and a second side. The first side defines a first firearm cradle. The first firearm cradle defines first and second channels crossing each other. The first channel defines a first channel axis and is sized and shaped to receive the forward portion of the firearm. The second channel defines a second channel axis and is sized and shaped to receive the forward portion of the firearm. The second firearm cradle defines third and fourth channels crossing each other. The third channel defines a third channel axis and is sized and shaped to receive the forward portion of the firearm. The fourth channel defines a fourth channel axis and is sized and shaped to receive the forward portion of the firearm. The first, second, third, and fourth channels are configured to selectively receive the forward portion of the firearm for supporting the firearm such that the firearm extends along a respective one of the first, second, third, or fourth channel axes.

In yet another aspect, a shooting rest for supporting a forward portion of a firearm on a support surface comprises a body having a plurality of sides including a top side, a bottom side, a front side, a rear side, a left side, and a right side. The body includes a hub and at least eight protrusions extending from the main body. The at least eight protrusions includes four upper protrusions and four lower protrusions. The four upper protrusions extend away from the hub in different directions. The four lower protrusions extending away from the hub in different directions. At least some of the protrusions cooperate to form channels sized and shaped to receive the forward portion of the firearm.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
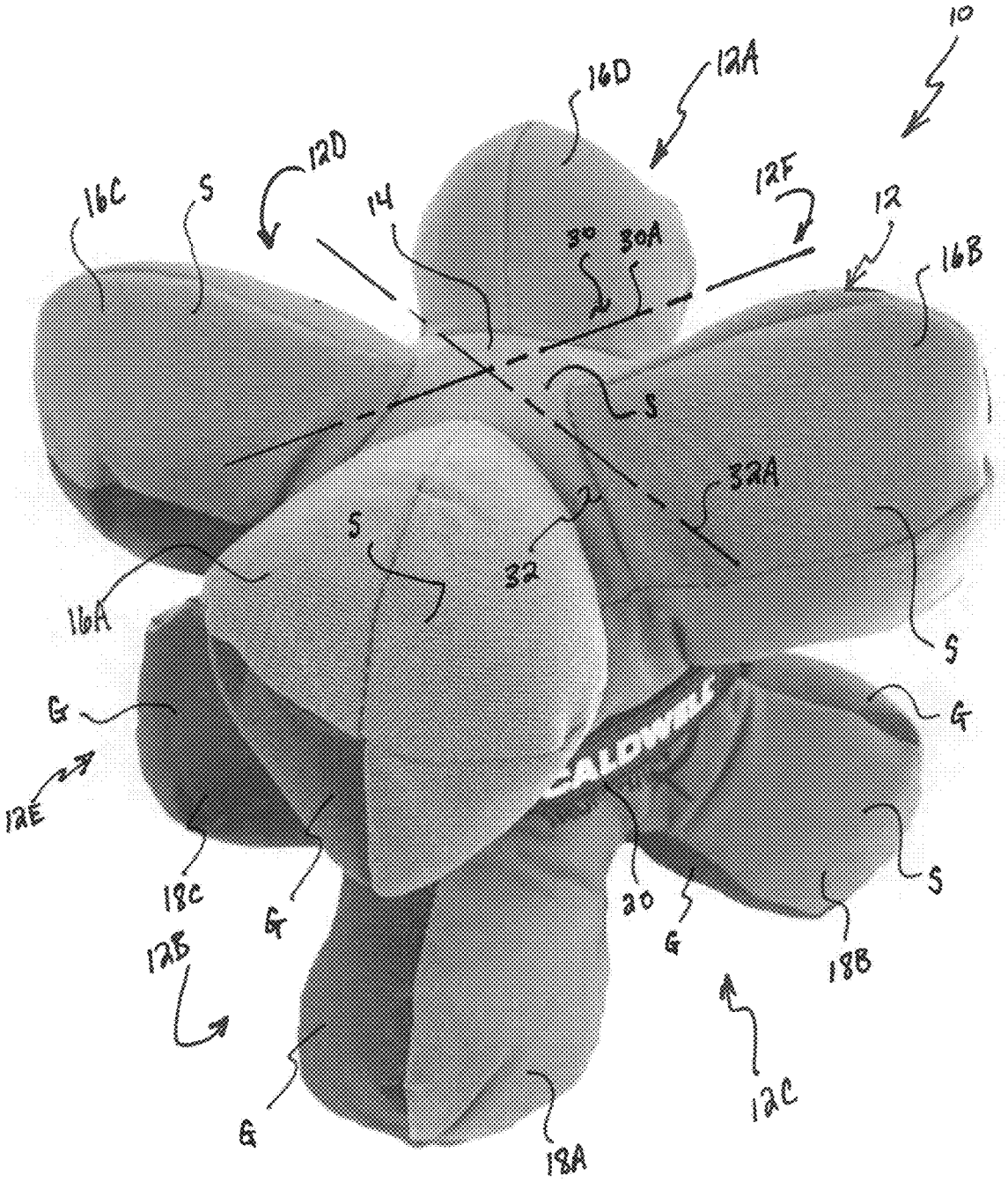
FIG. 1 is a top perspective of a firearm rest of the present disclosure.

Referring to FIG. 1, a firearm shooting rest of the present disclosure is designated generally by the reference number 10. The shooting rest can be used to support a firearm to assist a shooter in aiming the firearm at a target. For example, a forward portion of the firearm can rest on the shooting rest while the user holds a rear portion of the firearm and aims the firearm at the target.

The rest includes a body 12 including a hub 14 and a plurality of protrusions 16A-16D, 18A-18D (e.g., lobes) extending away from or protruding from the hub. In the illustrated embodiment, the body 12 comprises a bag, and interiors of the hub 14 and protrusions 16, 18 are filled with a media (e.g., sand, plastic pellets, etc.). As explained in further detail below, the rest 10 also includes a girth strap 20 extending around the body 12 and in particular around the hub 14. Bodies having other configurations can be used without departing from the scope of the present disclosure.

As will be explained in further detail below, the rest 10 can be used by a shooter in several different configurations depending on the preference of the shooter. For convenience, sides of the body 12 will be referred to herein with respect to the orientation of the rest 10 as shown in FIG. 1. For example, as shown in FIG. 1, the body 12 has a top side 12A (facing upward), a bottom side 12B (facing downward), a front side 12C (facing forward and to the right), a rear side 12D (facing rearward and to the left), a left side 12E (facing to the left and slightly forward), and a right side 12F (facing to the right and slightly rearward). It will be appreciated that, as viewed in other orientations of the rest 10, the top side 12A may be on the bottom, left, right, rear, etc. of the rest. In the selected orientation, whichever side of the bag 12 faces upward can be used as a cradle for supporting the firearm. In use, the side facing up (e.g., top side 12A) will be used to support the firearm, and the opposite side (e.g., bottom side 12B) will engage a support surface (e.g., a shooting bench, table, etc.) to support the rest 10.

In the illustrated embodiment, the plurality of protrusions includes an upper set of four protrusions 16A-16D and a lower set of four protrusions 18A-18D. The protrusions 16, 18 extend away from the hub 14 in different directions radiating from the hub. The four upper protrusions include a first upper protrusion 16A extending forward and to the left from the hub 14, a second upper protrusion 16B extending forward and to the right from the hub, a third upper protrusion 16C extending rearward and to the left from the hub, and a fourth upper protrusion 16D extending rearward and to the right from the hub. The four lower protrusions include a first lower protrusion 18A extending forward and to the left from the hub, a second lower protrusion 18B extending forward and to the right from the hub, a third lower protrusion 18C extending rearward and to the left from the hub, and a fourth lower protrusion 18D (FIG. 3) extending rearward and to the right from the hub.

The top, bottom, front, rear, left, and right sides 12A-12F of the body 12 comprise respective portions of the hub 14 and of the protrusions 16, 18. For example, the top side 12A comprises an upper surface of the hub 14 and upper surfaces of the four upper protrusions 16A-16D. The bottom side 12B comprises a bottom surface of the hub 14 and bottom surfaces of the four lower protrusions 18A-18D. The front side 12C comprises a front surface of the hub 14 and front surfaces of the first and second upper protrusions 16A, 16B and front surfaces of the first and second lower protrusions 18A, 18B. It will be understood that, in a similar manner, other sides of the body (rear, left, right) comprise respective portions (rear, left, right) of the hub and respective protrusions.

Figure 4:
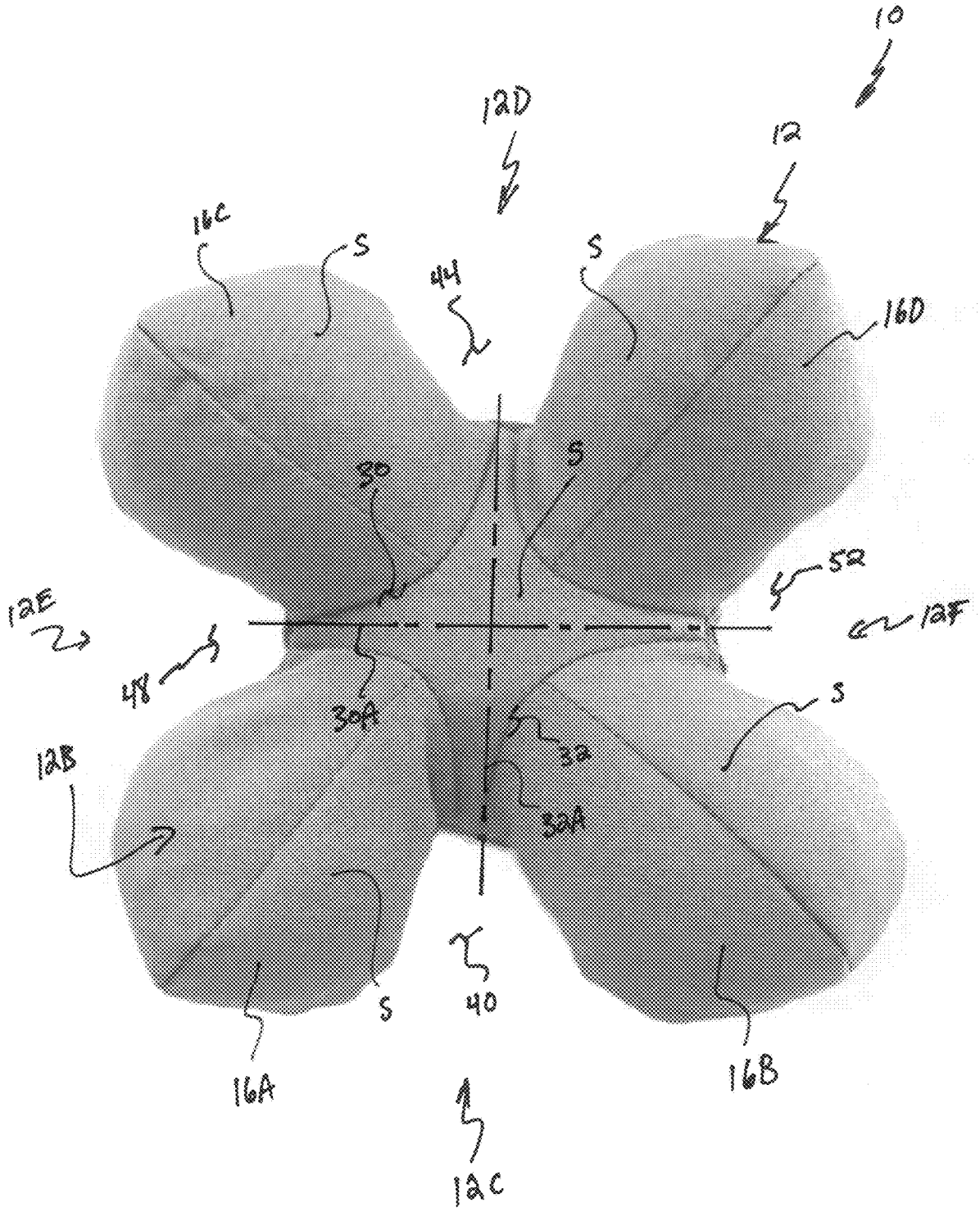
FIG. 4 is a top view of the firearm rest.

The arrangement of the hub 14 and protrusions 16, 18 is such that each side 12A-12F of the body defines a cradle including a pair of crossing channels sized and shaped so that a forward portion of a firearm (e.g., stock and/or barrel) could be at least partially received in a selected one of the channels to extend along a channel axis of the channel. The firearm received in the channel is at least partially supported by the firearm shooting rest 10. For example, as shown in FIGS. 1 and 4, the top side 12A includes a first top side channel 30 extending between the left and right sides 12E, 12F of the body 12, and the top side includes a second top side channel 32 extending between the front and rear sides 12C, 12D of the body. The first top side channel 30 defines a first channel axis 30A, and the second top side channel 32 defines a second channel axis 32A. The channel axes 30A, 32A are generally transverse to each other (e.g., generally perpendicular), and the channels 30, 32 intersect each other about midway along the length of the channels. In use, a firearm can be rested on the top side 12A of the bag such that the firearm extends along the length of one of the channels (e.g., channel 30) and crosses the other channel (e.g., channel 32). For example, a longitudinal axis of the firearm may be generally parallel with the channel axis (e.g., axis 30A) of the channel (e.g., channel 30) in which the firearm is received. The firearm would rest on the hub 14 and may be supported on the left and/or right sides of the firearm by respective protrusions 16A-16D. The other sides of the bag 12B-12F also include respective pairs of crossing channels, and each channel defines a respective channel axis.

Figure 2:
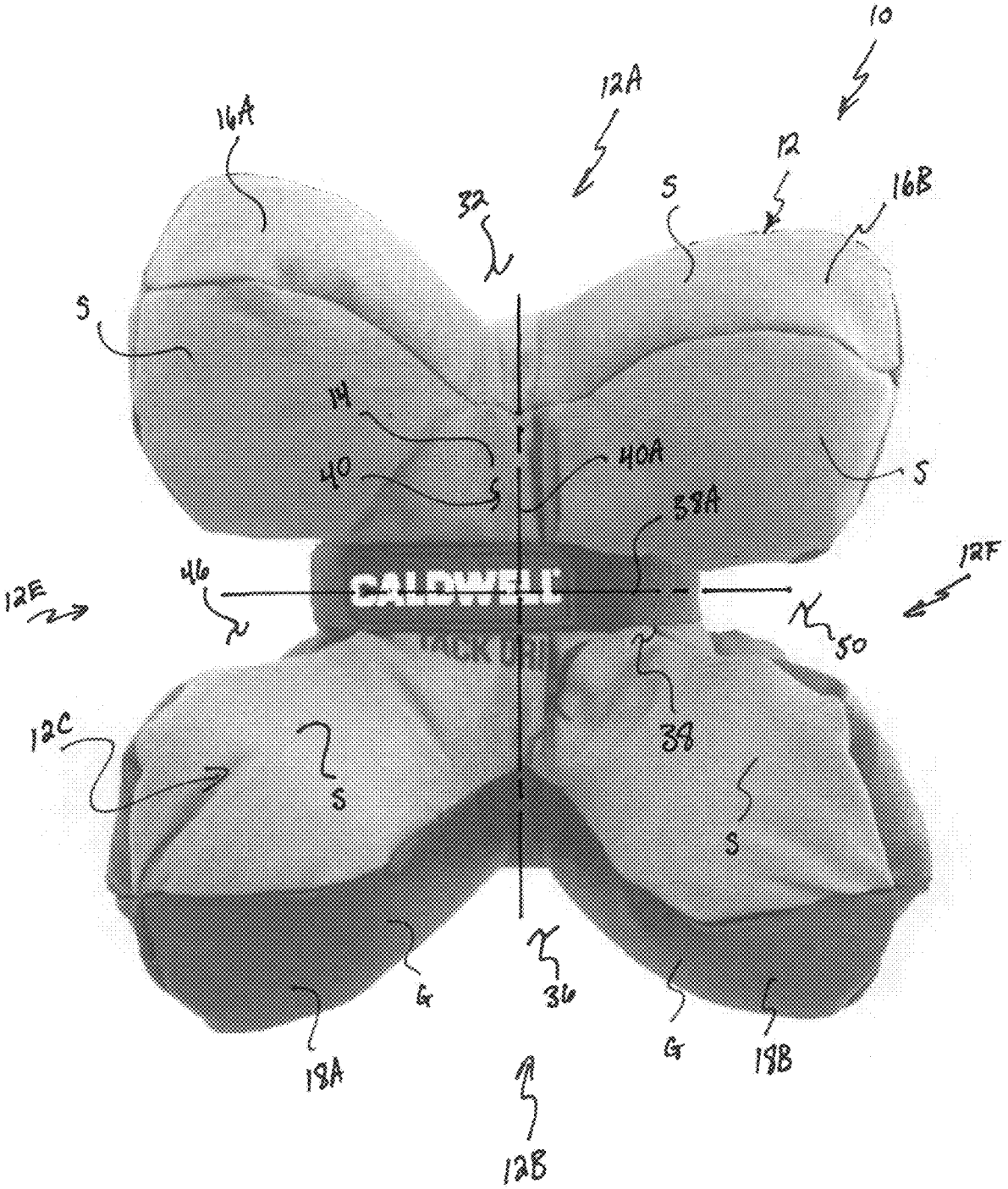
FIG. 2 is a front elevation of the firearm rest.
Figure 3:
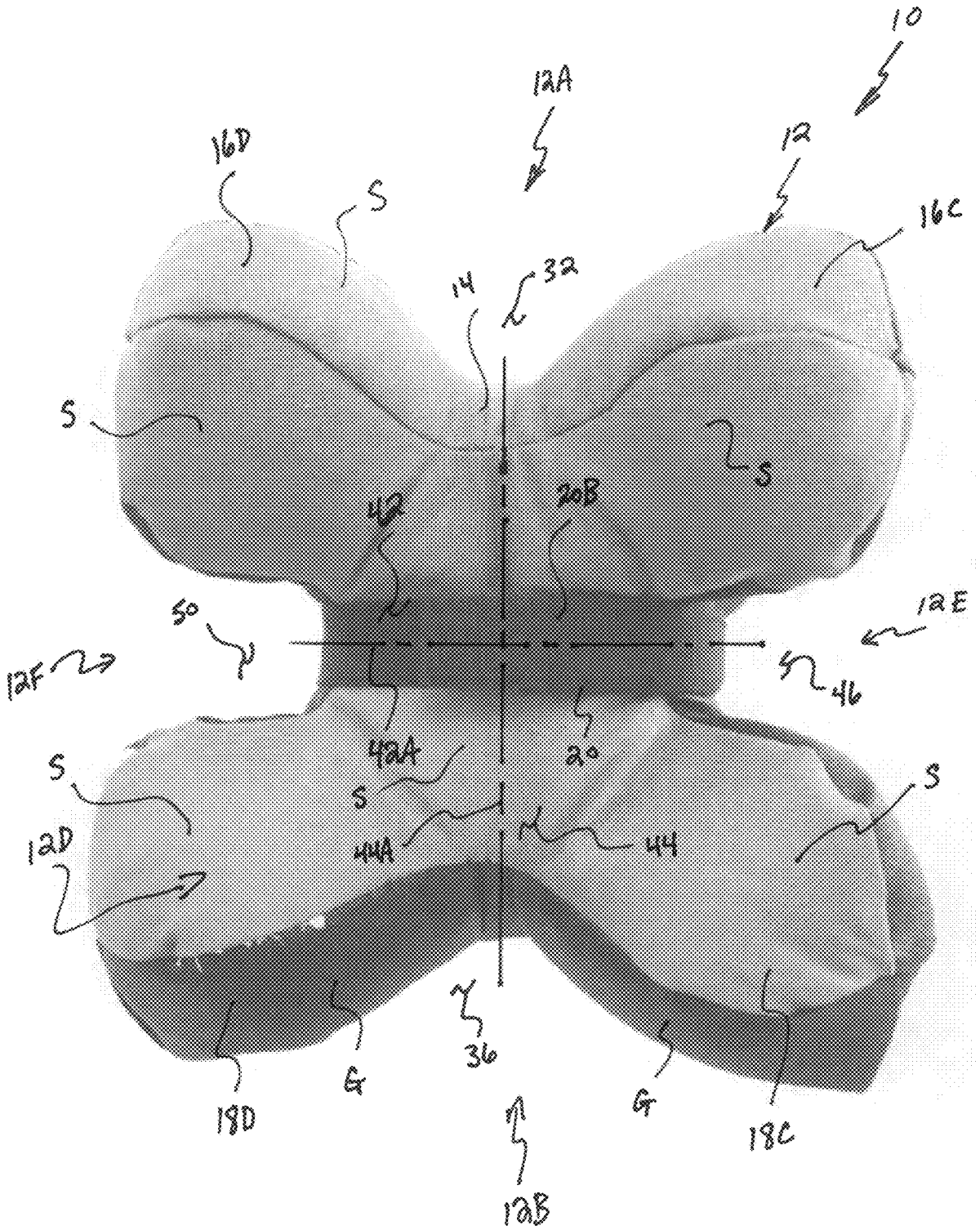
FIG. 3 is a rear elevation of the firearm rest.
Figure 5:
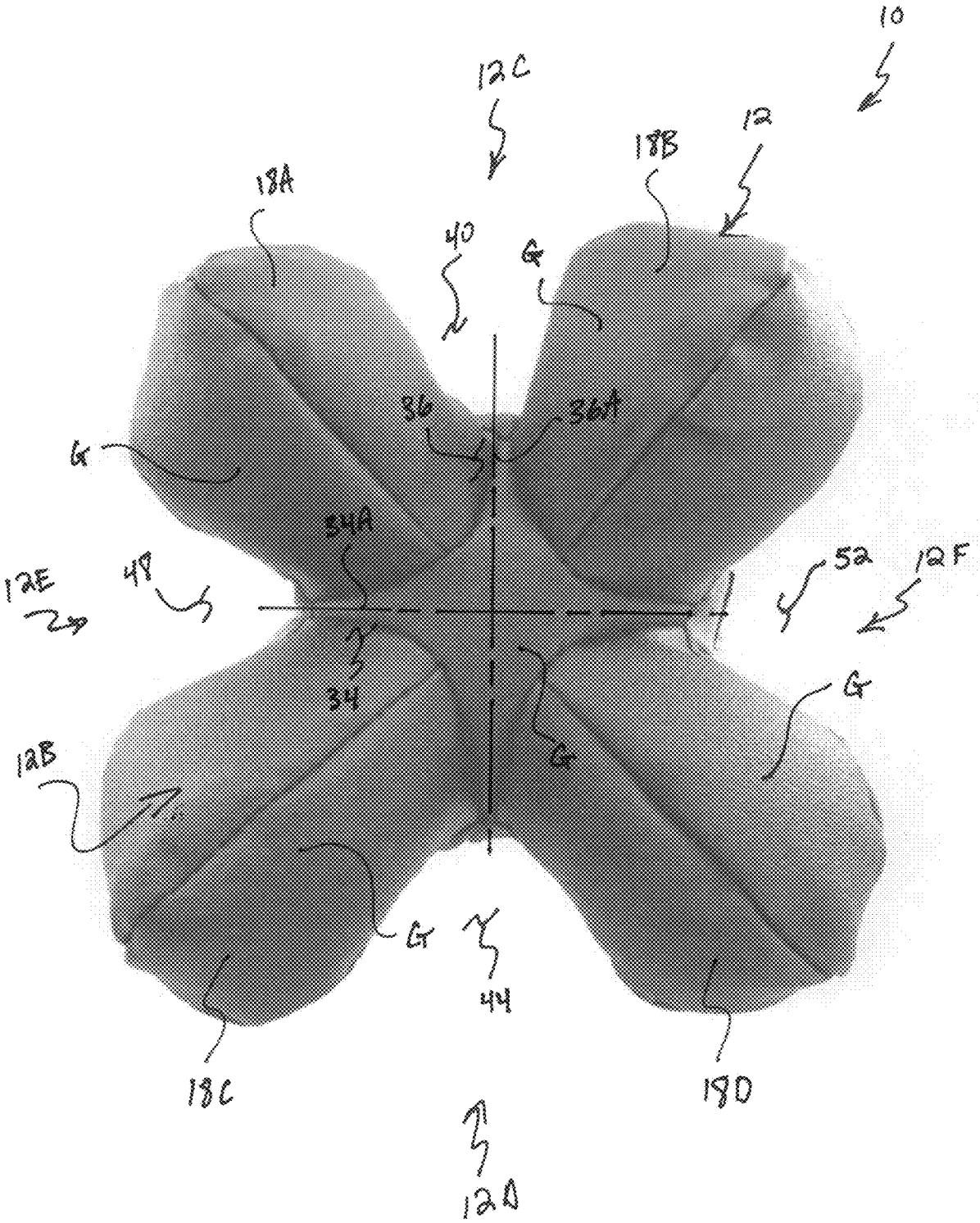
FIG. 5 is a bottom view of the firearm rest.
Figure 6:
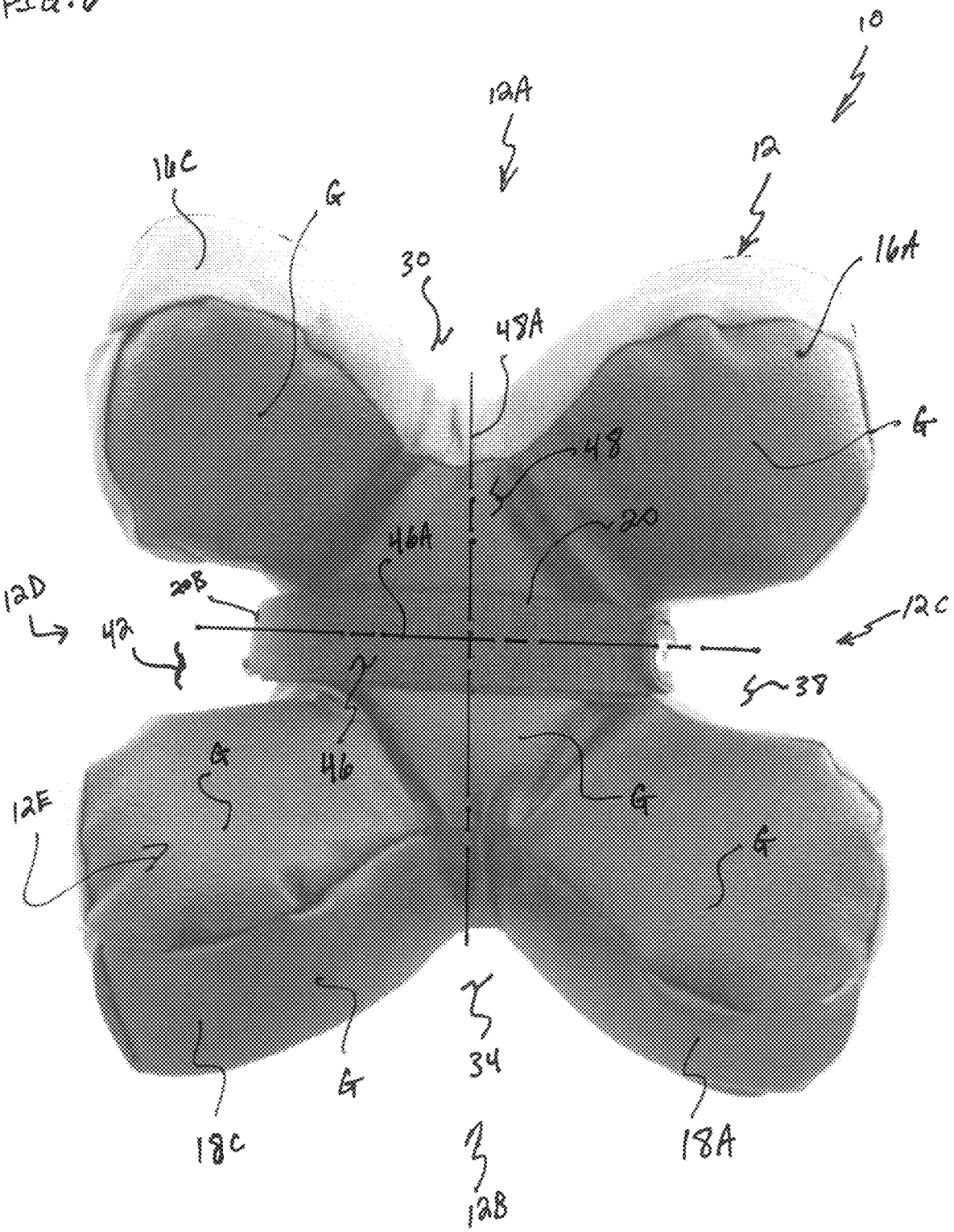
FIG. 6 is a left elevation of the firearm rest.

Referring to FIG. 5, the bottom side 12B includes a first bottom side channel 34 and a second bottom side channel 36 and respective first and second channel axes 34A, 36A. Referring to FIG. 2, the front side 12C includes a first front side channel 38 and a second front side channel 40 and respective first and second channel axes 38A, 40A. Referring to FIG. 3, the rear side 12D includes a first rear side channel 42 and a second rear side channel 44 and respective first and second channel axes 42A, 44A. Referring to FIG. 6, the left side 12E includes a first left side channel 46 and a second left side channel 48 and respective first and second channel axes 46A, 48A. Finally, referring to FIG. 7, the right side 12F includes a first right side channel 50 and a second right side channel 52 and respective first and second channel axes 50A, 52A. Accordingly, no matter which side 12A-12F faces upward, the user has a choice of two channels into which the firearm can be received to support the firearm. Moreover, the contour of the side of the body 12 facing downward provides a stable foundation of the body on the support surface and/or could receive a narrow support (e.g., rail) in a channel of the downward facing side. It will be appreciated that other configurations can be used without departing from the scope of the present disclosure. For example, fewer than all of the sides may define respective channels, sides may define other numbers of channels (e.g., one, three, etc.), and/or some or all of the sides may lack any channels (in which case a cradle defined by a side may be relatively planar). In one embodiment, a channel may not be well defined and may be formed in an upward facing surface of the body by settling or pressing the firearm into the body.

In the illustrated embodiment, the arrangement of the hub 14 and protrusions 16, 18 is such that when the body 12 is viewed normal to a side of the body (e.g., the top side 12A), the body is generally X-shaped. In the illustrated embodiment, as shown in FIGS. 2-7, the body 12 is generally X-shaped when viewed normal to any one of the top, bottom, front, rear, left, or right sides 12A-12F. It will be appreciated that other configurations can be used without departing form the scope of the present disclosure. For example, the cradles can have other configurations (e.g., have fewer channels, such as zero channels, or have additional channels). Moreover, additional protrusions (e.g., 9, 10, 11, 12, etc.) or fewer protrusions (e.g., 0, 1, 2, 3, 4, 5, 6, 7) can be provided.

The body 12 comprises slide-permitting material S and gripping material G defining portions of the outer surface of the body 12. The gripping material G is configured to frictionally grip the firearm and/or the support surface, and the slide-permitting material S is configured to permit sliding of the body 12 on the support surface and/or sliding of the firearm on the body. The shooting rest 10 is configurable such that the shooter can choose to have slide-permitting material S in contact with the firearm and the support surface; gripping material G in contact with the firearm and the support surface; slide-permitting material S in contact with the firearm and gripping material G in contact with the support surface; or gripping material G in contact with the firearm and slide-permitting material S in contact with the support surface. The shooter can choose the orientation of the rest 10 to select the desired locations of the gripping and slide-permitting material. Accordingly, the user can decide whether to orient the rest 10 such that the body 12 grips or permits sliding on the support surface and such that the body grips or permits sliding of the firearm on the upward facing side of the bag. In the illustrated embodiment, slide-permitting material S on the outer surface of the body 12 is represented by gray color, and gripping material G on the outer surface of the body is represented by black color. For example, the slide-permitting material S can comprise a canvas or nylon fabric (e.g., 200 denier nylon), and the gripping material G can comprise synthetic leather, real leather, polymeric material, etc. In one embodiment, the slide-permitting material S has a coefficient of static friction on dry steel in the inclusive range of about 0.1 to about 0.25, or about 0.25 or less (e.g., about 0.2), and the gripping material G has a coefficient of static friction on dry steel in the inclusive range of about 0.25 to about 0.9, or about 0.25 or greater (e.g., about 0.6). The coefficient of static friction of the slide-permitting material S is less than the coefficient of static friction of the gripping material G. It will be appreciated that the gripping material G may still permit sliding but permit sliding less readily than the slide-permitting material (e.g., require more force to overcome the static friction).

In the illustrated embodiment, the top, front, and rear sides 12A, 12C, 12D of the body 12 comprise slide-permitting material S, and the bottom, left, and right sides 12B, 12E, 12F comprise gripping material G. Moreover, in the illustrated embodiment, substantially all of the surfaces of the body 12 defining the cradles of the top, front, and rear sides 12A, 12C, 12D of the body comprise slide-permitting material S, and substantially all of the surfaces of the body defining the bottom, left, and right sides 12B, 12E, 12F of the body comprise gripping material G. In one embodiment, the gripping material G used on the various surfaces of the body 12 is the same type or composition of gripping material, and the slide-permitting material S is the same type or composition of slide-permitting material. Other configurations can be used without departing from the scope of the present disclosure. For example, only part of a surface of a side or cradle may be defined by slide-permitting or gripping material. Moreover, different compositions or types of slide-permitting or gripping material may be used on different sides. For example, gripping materials or slide-permitting materials having different coefficients of static friction may be used on different sides to permit further customization by the user based on the selected orientation of the shooting rest 10.

Figure 7:
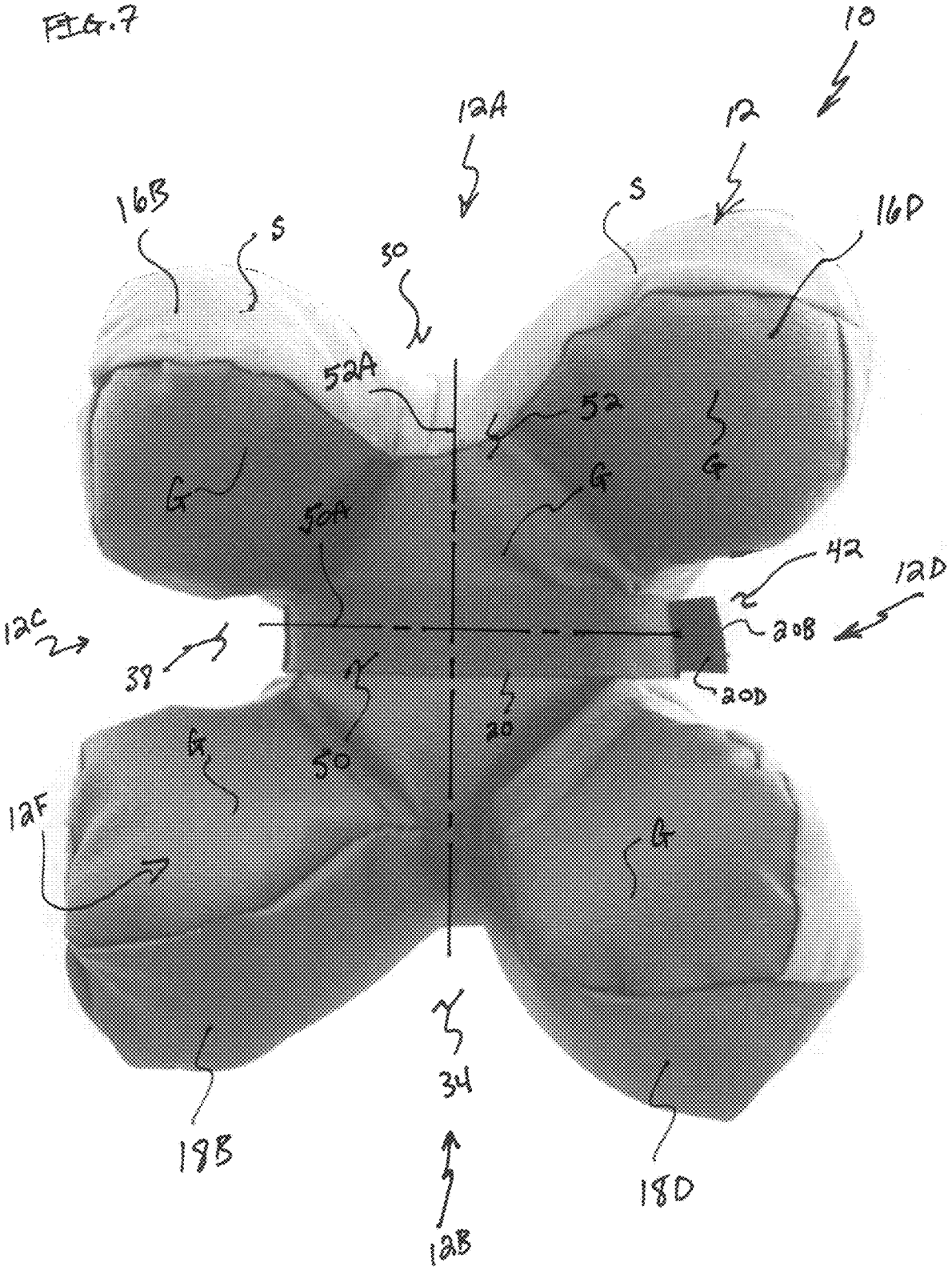
FIG. 7 is a right elevation of the firearm rest.
Figure 8:
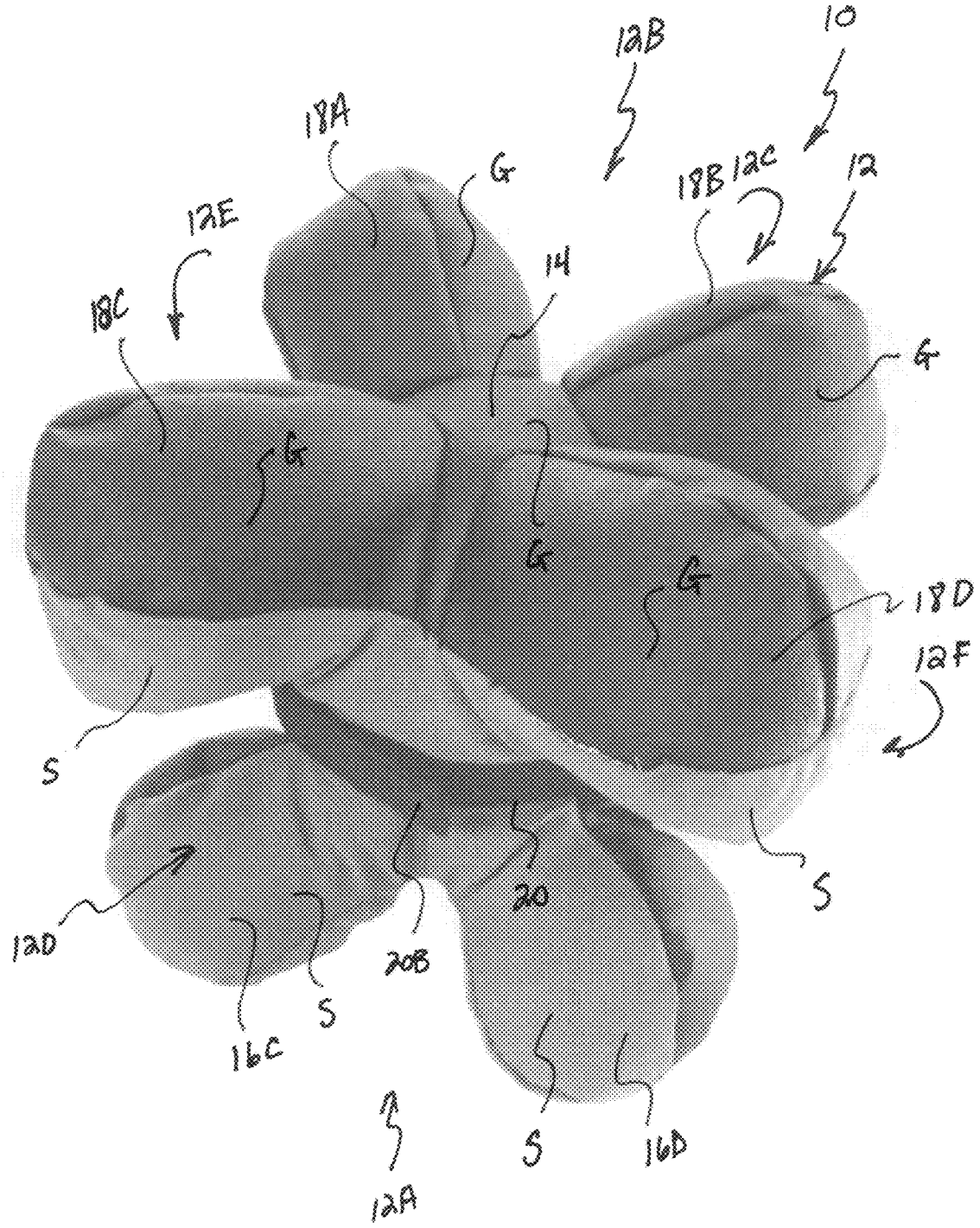
FIG. 8 is a bottom perspective of the firearm rest.
Figure 9:
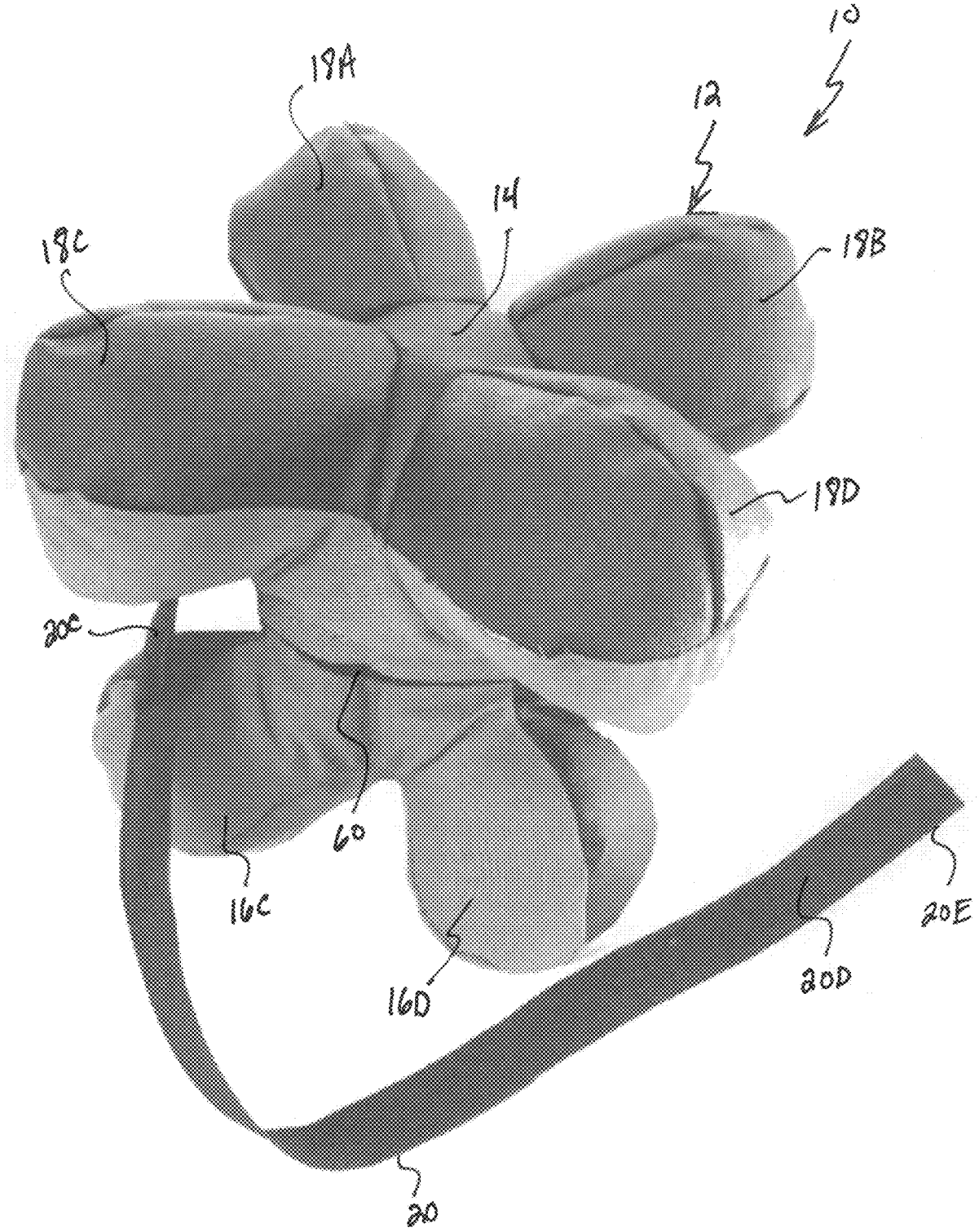
FIG. 9 is a view similar to FIG. 8 but showing a girth strap of the firearm rest unwrapped from a body of the firearm rest.

The girth strap 20 is adjustable to change firmness or compliance of the body 12 based on user preference. Referring to FIGS. 7-9, the girth strap 20 includes a proximal end 20A secured (e.g., sewn) to the hub 14 and includes a distal end 20B opposite the proximal end. The girth strap 20 is wrapped around the body 12 (around the hub 14) to permit the user to adjust constriction of the hub by the girth strap. The girth strap 20 includes a fastener to secure the strap in a selected wrapped configuration around the hub. In the illustrated embodiment, the fastener includes a first section of loop material 20C on the strap 20 near the proximal end 20A and a section of hook material 20D on the strap near the distal end 20E. When the girth strap 20 is wrapped around the hub 14 and pulled to the extent desired by the user, the hook material 20D is pressed against the loop material 20C to secure the girth strap 20 in the desired configuration. If desired, media can be added or removed from the interior of the body 12 to permit additional adjustment and/or a greater range of adjustment based on the setting of the girth strap 20. The body 12 includes an opening 60 (FIG. 9) in the hub 14 closed by hook and loop material through which media can be moved into or out of the body. It will be appreciated that other configurations can be used without departing from the scope of the present disclosure. For example, the body 12 or portions of the body (e.g., the protrusions 16, 18) may not comprise a bag filled with media and may have a more solid construction (e.g., solid material such as foam or polymeric material).

In view of the above description, it will be appreciated that the disclosed shooting rest 10 is configurable in at least two orientations selected from a group of orientations including: a first orientation in which a first firearm cradle of the plurality of firearm cradles faces upward for receiving the firearm and a side of the plurality of sides opposite the first firearm cradle faces downward for engaging the support surface, the first firearm cradle being defined by one of the sides (e.g., top side 12A) comprising slide-permitting material S for permitting the firearm to slide thereon, and the side opposite the first firearm cradle (e.g., bottom side 12B) being one of the sides comprising gripping material G for gripping the support surface; a second orientation in which a second firearm cradle of the plurality of firearm cradles faces upward for receiving the firearm and a side of the plurality of sides opposite the second firearm cradle faces downward for engaging the support surface, the second firearm cradle being defined by one of the sides (e.g., front side 12C) comprising slide-permitting material S for permitting the firearm to slide thereon, and the side opposite the second firearm cradle being one of the sides (e.g., rear side 12D) comprising slide-permitting material S for sliding on the support surface; a third orientation in which a third firearm cradle of the plurality of firearm cradles faces upward for receiving the firearm and a side of the plurality of sides opposite the third firearm cradle faces downward for engaging the support surface, the third firearm cradle being defined by one of the sides (e.g., bottom side 12B) comprising gripping material G for gripping the firearm, and the side opposite the third firearm cradle being one of the sides (e.g., top side 12A) comprising slide-permitting material S for sliding on the support surface; or a fourth orientation in which a fourth firearm cradle of the plurality of cradles faces upward for receiving the firearm and a side of the plurality of sides opposite the fourth firearm cradle faces downward for engaging the support surface, the fourth firearm cradle defined by one of the sides (e.g., left side 12E) comprising gripping material G for gripping the firearm, and the side opposite the fourth firearm cradle being one of the sides (e.g., right side 12F) comprising gripping material G for gripping the support surface. In the illustrated embodiment, the body 12 is configurable in all four of these configurations, but may be configurable in fewer than four without departing from the scope of the present disclosure.

In a method of using the firearm rest 10, a user selects a desired orientation of the shooting rest and supports the rest in that orientation on a support surface such as a shooting bench. The user then rests the firearm on the shooting rest 10 and aims the firearm at a target. A forward portion of the firearm may rest on the shooting rest 10, and a rear portion of the firearm may be held by the shooter. The user may desire to have gripping material G in contact with the firearm to restrict sliding of the firearm on the rest 10, or the user may desire to have slide-permitting material S in contact with the firearm to permit sliding of the firearm on the rest. The user may desire to have gripping material G in contact with the firearm and/or the support surface to prevent sliding. Depending on the orientation of the rest 10, the user can adjust aim of the firearm by sliding the firearm on slide-permitting material S of the rest, sliding slide-permitting material of the rest on the support surface, and/or pivoting the firearm on gripping material G of the rest without substantially sliding the firearm on the rest.

It will be apparent that modifications and variations are possible without departing from the scope of the appended claims.

As various changes could be made in the above constructions and methods without departing from the scope of the claims, it is intended that all matter contained in the above description and shown in the accompanying drawings shall be interpreted as illustrative and not in a limiting sense.

What is claimed is:

1. A selectively configurable shooting rest for supporting a firearm on a support surface, the shooting rest comprising:

a body having a plurality of sides, a first set of sides of the plurality of sides comprising gripping material configured to frictionally engage the firearm or the support surface to grip the firearm or the support surface, a second set of sides of the plurality of sides comprising slide-permitting material configured to permit the firearm to slide thereon or to slide on the support surface, a plurality of firearm cradles, the plurality of firearm cradles including at least two firearm cradles, each firearm cradle defined by a respective side of the body, the firearm cradles each configured to selectively receive the firearm to support the firearm, wherein the body is configurable in at least two orientations selected from a group of orientations including:

a first orientation in which a first firearm cradle of the plurality of firearm cradles faces upward for receiving the firearm and a side of the plurality of sides opposite the first firearm cradle faces downward for engaging the support surface, the first firearm cradle being defined by one of the sides comprising slide-permitting material for permitting the firearm to slide thereon, and the side opposite the first firearm cradle being one of the sides comprising gripping material for gripping the support surface, a second orientation in which a second firearm cradle of the plurality of firearm cradles faces upward for receiving the firearm and a side of the plurality of sides opposite the second firearm cradle faces downward for engaging the support surface, the second firearm cradle being defined by one of the sides comprising slide-permitting material for permitting the firearm to slide thereon, and the side opposite the second firearm cradle being one of the sides comprising slide-permitting material for sliding on the support surface, a third orientation in which a third firearm cradle of the plurality of firearm cradles faces upward for receiving the firearm and a side of the plurality of sides opposite the third firearm cradle faces downward for engaging the support surface, the third firearm cradle being defined by one of the sides comprising gripping material for gripping the firearm, and the side opposite the third firearm cradle being one of the sides comprising slide-permitting material for sliding on the support surface, or a fourth orientation in which a fourth firearm cradle of the plurality of cradles faces upward for receiving the firearm and a side of the plurality of sides opposite the fourth firearm cradle faces downward for engaging the support surface, the fourth firearm cradle defined by one of the sides comprising gripping material for gripping the firearm, and the side opposite the fourth firearm cradle being one of the sides comprising gripping material for gripping the support surface.

2. The shooting rest of claim 1, wherein the body is configurable in at least three orientations selected from the group of orientations.

3. The shooting rest of claim 1, wherein the body is configurable in all four orientations selected from the group of orientations.

4. The shooting rest of claim 1, wherein the gripping material has a first coefficient of static friction on dry steel and the slide-permitting material has a second coefficient of friction on dry steel less than the first coefficient of static of friction.

5. The shooting rest of claim 1, wherein the gripping material has a coefficient of static friction on dry steel of about 0.25 or greater than 0.25.

6. The shooting rest of claim 1, wherein the slide-permitting material has a coefficient of static friction on dry steel of about 0.25 or less than 0.25.

7. The shooting rest of claim 1, wherein the plurality of sides comprises a top side, a bottom side, a front side, a rear side, a left side, and a right side, the first set of sides includes the left side, the right side, and the bottom side, and the second set of sides includes the top side, the front side, and the rear side.

8. The shooting rest of claim 1, wherein the plurality of firearm cradles comprises at least three firearm cradles, the three firearm cradles being located on different sides of the body.

9. The shooting rest of claim 8, wherein each of the firearm cradles defines crossing channels each configured to receive the firearm therein.

10. The shooting rest of claim 1, wherein the plurality of firearm cradles comprises at least four firearm cradles, the four firearm cradles being located on different sides of the body.

11. The shooting rest of claim 1, wherein a first firearm cradle of the plurality of firearm cradles comprises first and second channels crossing each other, the first and second channels each defining a respective channel axis along which the firearm extends when received in the channel.

12. The shooting rest of claim 11, wherein a second firearm cradle of the plurality of firearm cradles comprises third and fourth channels crossing each other, the third and fourth channels each defining a respective channel axis along which the firearm extends when received in the channel.

13. The shooting rest of claim 1, wherein each of the firearm cradles defines a channel configured to receive the firearm, and wherein each side of the first set of sides comprises a same composition of gripping material.

14. The shooting rest of claim 1, wherein each side of the body comprising gripping material is formed entirely by gripping material, and wherein each side of the body comprising slide-permitting material is formed entirely by slide-permitting material.

15. A shooting rest for supporting a forward portion of a firearm on a support surface, the shooting rest comprising:

a body having a plurality of sides including a first side and a second side, the first side defining a first firearm cradle, the first firearm cradle defining first and second channels crossing each other, the first channel defining a first channel axis and being sized and shaped to receive the forward portion of the firearm, the second channel defining a second channel axis and being sized and shaped to receive the forward portion of the firearm, the second side defining a second firearm cradle, the second firearm cradle defining third and fourth channels crossing each other, the third channel defining a third channel axis and being sized and shaped to receive the forward portion of the firearm, the fourth channel defining a fourth channel axis and being sized and shaped to receive the forward portion of the firearm, the first, second, third, and fourth channels being configured to selectively receive the firearm for supporting the firearm such that the firearm extends along a respective one of the first, second, third, or fourth channel axes;

wherein the plurality of sides includes a third side, the third side defining a third firearm cradle, the third firearm cradle defining fifth and sixth channels crossing each other, the fifth channel defining a fifth channel axis, the sixth channel defining a sixth channel axis, the fifth and sixth channels being configured to selectively receive the firearm for supporting the firearm such that the firearm extends along a respective one of the fifth or sixth channel axes.

16. The shooting rest of claim 15, wherein the plurality of sides further includes fourth, fifth, and sixth sides, each of the fourth, fifth, and sixth sides defining a respective cradle defining two channels crossing each other.

17. A shooting rest for supporting a forward portion of a firearm on a support surface, the shooting rest comprising:

a body having a plurality of sides including a top side, a bottom side, a front side, a rear side, a left side, and a right side, the body including a hub and at least eight protrusions extending from the hub, the at least eight protrusions including four upper protrusions and four lower protrusions, the four upper protrusions extending away from the hub in different directions, the four lower protrusions extending away from the hub in different directions, at least some of the protrusions cooperating to define channels sized and shaped to receive the forward portion of the firearm;

wherein each of at least three sides selected from the top side, the bottom side, the front side, the rear side, the left side, and the right side, includes a channel defining a respective channel axis, each channel being sized and shaped to receive the forward portion of the firearm for supporting the firearm such that the firearm extends along the respective channel axis.

18. The shooting rest of claim 17, wherein when the body is viewed normal to at least one of the sides of the body, the body is generally X-shaped.

19. The shooting rest of claim 17, wherein the four upper protrusions include a first upper protrusion extending forward and to the left from the hub, a second upper protrusion extending forward and to the right from the hub, a third upper protrusion extending rearward and to the left from the hub, and a fourth upper protrusion extending rearward and to the right from the hub.

20. The shooting rest of claim 19, wherein the four lower protrusions include a first lower protrusion extending forward and to the left from the hub, a second lower protrusion extending forward and to the right from the hub, a third lower protrusion extending rearward and to the left from the hub, and a fourth lower protrusion extending rearward and to the right from the hub.

21. The shooting rest of claim 19, wherein the four upper protrusions extend laterally outboard of the hub.

22. The shooting rest of claim 20, wherein the four lower protrusions extend laterally outboard of the hub.

23. The shooting rest of claim 17, wherein each of the top side, the bottom side, the front side, the rear side, the left side, and the right side, includes at least one of said channel.

24. A shooting rest for supporting a forward portion of a firearm on a support surface, the shooting rest comprising:

a body having a plurality of sides including a first side and a second side, the first side defining a first firearm cradle, the first firearm cradle defining first and second channels crossing each other, the first channel defining a first channel axis and being sized and shaped to receive the forward portion of the firearm, the second channel defining a second channel axis and being sized and shaped to receive the forward portion of the firearm, the second side defining a second firearm cradle, the second firearm cradle defining third and fourth channels crossing each other, the third channel defining a third channel axis and being sized and shaped to receive the forward portion of the firearm, the fourth channel defining a fourth channel axis and being sized and shaped to receive the forward portion of the firearm, the first, second, third, and fourth channels being configured to selectively receive the firearm for supporting the firearm such that the firearm extends along a respective one of the first, second, third, or fourth channel axes;

wherein the body has a top side, a bottom side, a front side, a rear side, a left side, and a right side, the first side being the top side, and the second side being one of the front side, the rear side, the left side, or the right side.

25. A shooting rest for supporting a forward portion of a firearm on a support surface, the shooting rest comprising:

a body having a plurality of sides including a top side, a bottom side, a front side, a rear side, a left side, and a right side, the body including a hub and at least eight protrusions extending from the hub, the at least eight protrusions including four upper protrusions and four lower protrusions, the four upper protrusions extending away from the hub in different directions, the four lower protrusions extending away from the hub in different directions, at least some of the protrusions cooperating to define channels sized and shaped to receive the forward portion of the firearm, at least one of the protrusions extending upward outboard of the hub, at least one of the protrusions extending downward outboard of the hub, and at least one of the protrusions extending forward outboard of the hub;

wherein said channels include at least a first channel, a second channel, and a third channel, the first channel being on the top side, the second channel being on the bottom side, and the third channel being on one of the front side, rear side, left side, or right side.

26. The shooting rest of claim 25, wherein at least one of the protrusions extends rearward outboard of the hub, at least one of the protrusions extends to the left outboard of the hub, and at least one of the protrusions extends to the right outboard of the hub.

* * * * *